US008904814B2

(12) United States Patent
Tolbert, Jr. et al.

(10) Patent No.: US 8,904,814 B2
(45) Date of Patent: Dec. 9, 2014

(54) SYSTEM AND METHOD FOR DETECTING A FAULT CONDITION IN A COMPRESSOR

(75) Inventors: John W. Tolbert, Jr., Bristol, TN (US); Bruce A. Moody, Kingsport, TN (US); Jerry D. Edwards, Bristol, TN (US); David R. Gilliam, Bristol, VA (US); Eugene K. Chumley, Abingdon, VA (US); Richard C. Denzau, Abingdon, VA (US); Scott Hix, Bristol, VA (US); Justin M. Toner, Kingsport, TN (US); Mark R. Trent, Bristol, VA (US); Tim M. Wampler, Bluff City, TN (US); John R. Williams, Bristol, VA (US)

(73) Assignee: Bristol Compressors, International Inc., Bristol, VA (US)

( * ) Notice: Subject to any disclaimer, the term of this patent is extended or adjusted under 35 U.S.C. 154(b) by 964 days.

(21) Appl. No.: 12/494,158

(22) Filed: Jun. 29, 2009

(65) Prior Publication Data

US 2009/0324428 A1 Dec. 31, 2009

Related U.S. Application Data

(60) Provisional application No. 61/076,676, filed on Jun. 29, 2008, provisional application No. 61/076,675, filed on Jun. 29, 2008.

(51) Int. Cl.
*F25B 49/00* (2006.01)
*F04B 39/02* (2006.01)

(52) U.S. Cl.
CPC ..... *F04B 39/0207* (2013.01); *F04B 2203/0209* (2013.01); *F04B 2203/0201* (2013.01)
USPC ..... 62/230

(58) Field of Classification Search
USPC ..... 62/129, 158, 178, 180, 228.1, 228.4, 62/229, 230
See application file for complete search history.

(56) References Cited

U.S. PATENT DOCUMENTS

| | | | | |
|---|---|---|---|---|
| 2,219,199 | A | | 10/1940 | Renner |
| 2,390,650 | A | | 12/1945 | Hollatz et al. |
| 3,261,172 | A | | 7/1966 | Grant |
| 3,388,559 | A | | 6/1968 | Johnson |
| 3,411,313 | A | | 11/1968 | Brown et al. |
| 3,874,187 | A | | 4/1975 | Anderson |
| 3,903,710 | A | | 9/1975 | Quatman |
| 4,045,973 | A | * | 9/1977 | Anderson et al. ..... 62/158 |
| 4,047,242 | A | | 9/1977 | Jakob et al. |

(Continued)

FOREIGN PATENT DOCUMENTS

| | | | |
|---|---|---|---|
| CN | 2401835 | U | 10/2000 |
| DE | 4338939 | C1 | 2/1995 |

(Continued)

*Primary Examiner* — Marc Norman
(74) *Attorney, Agent, or Firm* — McNees Wallace & Nurick LLC

(57) ABSTRACT

A system and method for determining a fault condition in a compressor is provided. The current of a motor drive powering the compressor and the outdoor ambient temperature are measured and used to determine if a fault condition or a potential fault condition is present in the compressor. If a fault condition is determined to be present, the compressor can be shutdown to avoid damage to the compressor. If a potential fault condition is determined, remedial action can be taken to attempt to prevent the fault condition from occurring and shutting down the compressor.

18 Claims, 6 Drawing Sheets

(56) References Cited

U.S. PATENT DOCUMENTS

| | | | | |
|---|---|---|---|---|
| 4,475,358 | A | 10/1984 | Seifert et al. | |
| 4,487,028 | A | 12/1984 | Foye | |
| 4,514,989 | A * | 5/1985 | Mount | 62/201 |
| 4,577,471 | A | 3/1986 | Meckler | |
| 4,616,693 | A | 10/1986 | Dietzsch et al. | |
| 4,709,560 | A | 12/1987 | Voorhis et al. | |
| 4,720,981 | A | 1/1988 | Helt et al. | |
| 4,891,953 | A | 1/1990 | Isono | |
| 4,895,005 | A | 1/1990 | Norbeck et al. | |
| 4,951,475 | A | 8/1990 | Alsenz | |
| 4,965,658 | A | 10/1990 | Norbeck et al. | |
| 5,012,656 | A | 5/1991 | Tamura | |
| 5,025,638 | A | 6/1991 | Yamagishi et al. | |
| 5,044,167 | A | 9/1991 | Champagne | |
| 5,052,186 | A | 10/1991 | Dudley et al. | |
| 5,062,276 | A | 11/1991 | Dudley | |
| 5,062,277 | A | 11/1991 | Heitmann et al. | |
| 5,066,197 | A | 11/1991 | Champagne | |
| 5,081,846 | A | 1/1992 | Dudley et al. | |
| 5,088,297 | A | 2/1992 | Maruyama et al. | |
| 5,107,685 | A * | 4/1992 | Kobayashi | 62/115 |
| 5,144,812 | A | 9/1992 | Mills, Jr. et al. | |
| 5,177,972 | A | 1/1993 | Sillato et al. | |
| 5,182,915 | A | 2/1993 | Iidea et al. | |
| 5,220,809 | A | 6/1993 | Voss | |
| 5,263,335 | A | 11/1993 | Isono et al. | |
| 5,285,646 | A | 2/1994 | TaeDuk | |
| 5,303,561 | A | 4/1994 | Bahel et al. | |
| 5,315,376 | A | 5/1994 | Wada et al. | |
| 5,323,619 | A | 6/1994 | Kim | |
| 5,350,039 | A | 9/1994 | Voss et al. | |
| 5,475,985 | A | 12/1995 | Heinrichs et al. | |
| 5,533,352 | A | 7/1996 | Bahel et al. | |
| 5,546,073 | A * | 8/1996 | Duff et al. | 340/585 |
| 5,553,997 | A | 9/1996 | Goshaw et al. | |
| 5,568,732 | A | 10/1996 | Isshiki et al. | |
| 5,651,260 | A | 7/1997 | Goto et al. | |
| 5,671,607 | A | 9/1997 | Clemens et al. | |
| 5,729,995 | A | 3/1998 | Tajima | |
| 5,752,385 | A | 5/1998 | Nelson | |
| 5,764,011 | A * | 6/1998 | Nakae et al. | 318/471 |
| 5,765,994 | A | 6/1998 | Barbier | |
| 5,826,643 | A | 10/1998 | Galyon et al. | |
| 6,034,872 | A | 3/2000 | Chrysler et al. | |
| 6,041,609 | A | 3/2000 | Hornsleth et al. | |
| 6,070,110 | A | 5/2000 | Shah et al. | |
| 6,116,040 | A | 9/2000 | Stark | |
| 6,172,476 | B1 | 1/2001 | Tolbert, Jr. et al. | |
| 6,237,420 | B1 | 5/2001 | Rowlette et al. | |
| 6,330,153 | B1 | 12/2001 | Ketonen et al. | |
| 6,353,303 | B1 | 3/2002 | Ramachandran et al. | |
| 6,363,732 | B1 | 4/2002 | Bluhm | |
| 6,375,563 | B1 | 4/2002 | Colter | |
| 6,384,563 | B1 * | 5/2002 | Someya | 318/700 |
| 6,434,003 | B1 | 8/2002 | Roy et al. | |
| 6,434,960 | B1 | 8/2002 | Rousseau | |
| 6,511,295 | B2 | 1/2003 | Suitou et al. | |
| 6,523,361 | B2 | 2/2003 | Higashiyama | |
| 6,524,082 | B2 | 2/2003 | Morita et al. | |
| 6,560,980 | B2 | 5/2003 | Gustafson et al. | |
| 6,560,984 | B2 | 5/2003 | Bellet | |
| 6,604,372 | B2 | 8/2003 | Baumert et al. | |
| 6,639,798 | B1 | 10/2003 | Jeter et al. | |
| 6,663,358 | B2 | 12/2003 | Loprete et al. | |
| 6,675,590 | B2 | 1/2004 | Aarestrup | |
| 6,688,124 | B1 | 2/2004 | Stark et al. | |
| 6,704,202 | B1 | 3/2004 | Hamaoka et al. | |
| 6,808,372 | B2 | 10/2004 | Makino et al. | |
| 6,817,198 | B2 | 11/2004 | Wilson et al. | |
| 6,826,923 | B2 | 12/2004 | Nakano et al. | |
| 6,829,904 | B2 | 12/2004 | Roh et al. | |
| 6,874,329 | B2 | 4/2005 | Stark et al. | |
| 6,886,354 | B2 | 5/2005 | Dudley | |
| 7,164,242 | B2 | 1/2007 | Federman et al. | |
| 7,628,028 | B2 | 12/2009 | Tolbert, Jr. et al. | |
| 7,878,006 | B2 * | 2/2011 | Pham | 62/127 |
| 2001/0000880 | A1 | 5/2001 | Chu et al. | |
| 2001/0017039 | A1 | 8/2001 | Weimer | |
| 2002/0043074 | A1 | 4/2002 | Ott et al. | |
| 2002/0108384 | A1 | 8/2002 | Higashiyama | |
| 2003/0089121 | A1 | 5/2003 | Wilson et al. | |
| 2003/0205052 | A1 | 11/2003 | Kim et al. | |
| 2004/0003610 | A1 * | 1/2004 | So et al. | 62/175 |
| 2004/0055322 | A1 | 3/2004 | Monfarad | |
| 2004/0065095 | A1 | 4/2004 | Osborne et al. | |
| 2004/0139112 | A1 * | 7/2004 | Wickham et al. | 707/104.1 |
| 2004/0163403 | A1 | 8/2004 | Monfarad | |
| 2004/0174650 | A1 * | 9/2004 | Wyatt et al. | 361/93.1 |
| 2004/0194485 | A1 | 10/2004 | Dudley | |
| 2004/0237551 | A1 | 12/2004 | Schwarz et al. | |
| 2004/0237554 | A1 | 12/2004 | Stark et al. | |
| 2004/0261441 | A1 | 12/2004 | Turner et al. | |
| 2005/0076665 | A1 | 4/2005 | Pruitt | |
| 2005/0083630 | A1 * | 4/2005 | Jun et al. | 361/139 |
| 2005/0086959 | A1 | 4/2005 | Wilson et al. | |
| 2005/0100449 | A1 * | 5/2005 | Hahn et al. | 417/279 |
| 2005/0247073 | A1 | 11/2005 | Hikawa et al. | |
| 2006/0010891 | A1 | 1/2006 | Rayburn | |
| 2007/0022765 | A1 | 2/2007 | Lifson et al. | |
| 2007/0095081 | A1 | 5/2007 | Ootori et al. | |
| 2007/0256432 | A1 | 11/2007 | Zugibe et al. | |
| 2008/0041081 | A1 * | 2/2008 | Tolbert | 62/228.4 |
| 2009/0090118 | A1 | 4/2009 | Pham et al. | |
| 2009/0266091 | A1 | 10/2009 | Tolbert, Jr. | |
| 2009/0324426 | A1 | 12/2009 | Moody et al. | |
| 2009/0324427 | A1 | 12/2009 | Tolbert, Jr. et al. | |

FOREIGN PATENT DOCUMENTS

| | | | |
|---|---|---|---|
| EP | 0196863 | A1 | 10/1986 |
| EP | 0376498 | A1 | 7/1990 |
| EP | 0933603 | A1 | 8/1999 |
| EP | 1260774 | A2 | 11/2002 |
| EP | 1164035 | B1 | 8/2004 |
| JP | 58127038 | A | 7/1983 |
| JP | 6229853 | A | 2/1987 |
| JP | 1296038 | A | 11/1989 |
| JP | 4338670 | A | 11/1992 |
| JP | 6213498 | A | 8/1994 |
| JP | 814709 | A | 1/1996 |
| JP | 8145405 | A | 6/1996 |
| JP | 2000111216 | A | 4/2000 |
| JP | 2001163038 | A | 6/2001 |
| JP | 2003214659 | A | 7/2003 |
| JP | 2004219031 | A | 8/2004 |
| JP | 2004325023 | A | 11/2004 |
| JP | 2006343095 | A * | 12/2006 |
| WO | 9411212 | A1 | 5/1994 |
| WO | 9815790 | A1 | 4/1998 |
| WO | 0022358 | A1 | 4/2000 |
| WO | 0078111 | A1 | 12/2000 |

* cited by examiner

SYSTEM AND METHOD FOR DETECTING A FAULT CONDITION IN A COMPRESSOR

CROSS REFERENCE TO RELATED APPLICATIONS

This application claims the benefit of U.S. Provisional Application 61/076,676, filed Jun. 29, 2008 and U.S. Provisional Application 61/076,675, filed Jun. 29, 2008.

BACKGROUND

The application generally relates to fault detection in a compressor. The application relates more specifically to detecting faults in a compressor based on the measured current of a motor drive and the outdoor ambient temperature.

Many compressors employ numerous protection features to provide for safe and reliable operation of the compressor and the corresponding system, e.g., an air conditioning system or a heat pump system, in which the compressor is incorporated. Some examples of compressor protection features include an internal line break motor or overload protector (to prevent the motor from exceeding predetermined thermal limits during operation), an internal pressure relief valve (to detect excessive discharge pressure), a high pressure switch (to detect a high pressure condition in the compressor), and a low pressure switch (to detect a low pressure condition in the compressor). The incorporation and inclusion of these protection features into a compressor can be very complex and costly to design and implement.

Therefore what is needed is a system and method to determine fault conditions in a compressor without the need for numerous protection devices.

SUMMARY

The present application relates to a method of determining fault conditions in a compressor for a heating, ventilation, and air conditioning (HVAC) system. The method includes measuring an outdoor ambient temperature for the HVAC system, measuring a current of a motor drive for the compressor and selecting a predetermined range of current values for a motor drive current based on the measured outdoor ambient temperature. The predetermined range of current values are bounded by an upper current value and a lower current value. The predetermined range of current values corresponds to acceptable operation of the compressor. The method further includes comparing the measured current to the predetermined range of current values and determining a potential fault condition in response to the measured current being greater than the upper current value or less than the lower current value. The method also includes changing an operating condition of the compressor in response to the determined potential fault condition.

The present application further relates to a system including a compressor and a motor drive configured to receive power from an AC power source and to provide power to the compressor. The motor drive having a first sensor to measure a value representative of a current in the motor drive. The system also including a second sensor positioned to measure a value representative of the outdoor ambient temperature and a controller to control operation of the motor drive. The controller including an interface to receive the value representative of a current in the motor drive and the value representative of the outdoor ambient temperature and a processor to process the value representative of a current in the motor drive and the value representative of the outdoor ambient temperature to determine a fault condition in the compressor and to initiate a remedial action upon a fault condition being determined.

One advantage of the present application is that one or more of a line break overload protector for a multi-phase motor, an internal pressure relief valve, a high pressure switch and/or a low pressure switch can be eliminated from the compressor.

DETAILED DESCRIPTION OF THE EXEMPLARY EMBODIMENTS

Figure 1:
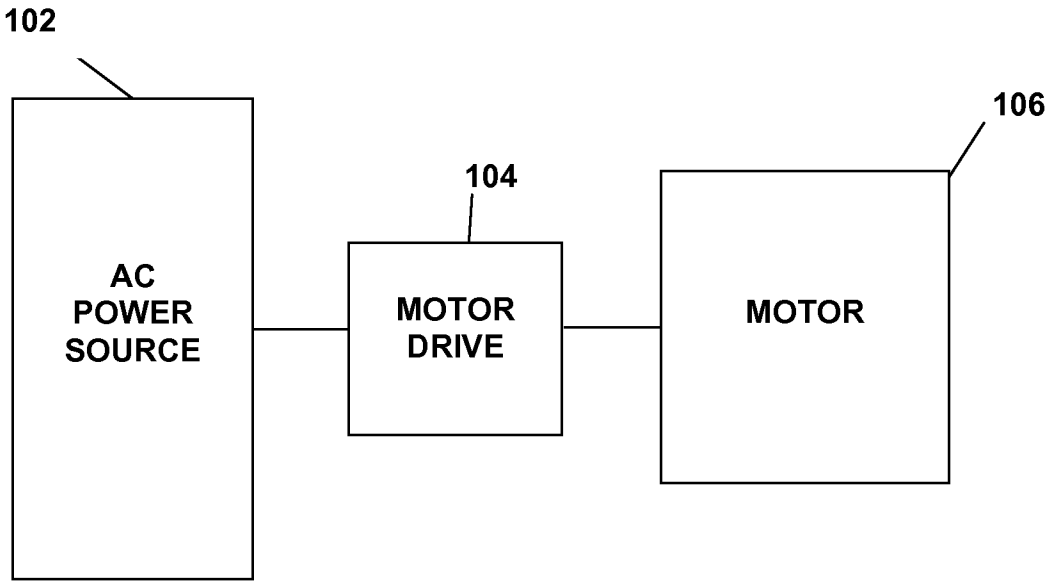
FIG. 1 schematically shows an exemplary embodiment of a system for providing power to a motor.

FIG. 1 shows an embodiment of a system for providing power to a motor. An AC power source 102 supplies electrical power to a motor drive 104, which provides power to a motor 106. The motor 106 can be used to power a motor driven component, e.g., a compressor, fan, or pump, of a vapor compression system (see generally, FIGS. 3 and 4). The AC power source 102 provides single phase or multi-phase (e.g., three phase), fixed voltage, and fixed frequency AC power to the motor drive 104. The motor drive 104 can accommodate virtually any AC power source 102. In an exemplary embodiment, the AC power source 102 can supply an AC voltage or line voltage of between about 180 V to about 600 V, such as 187 V, 208 V, 220 V, 230 V, 380 V, 415 V, 460 V, 575 V or 600 V, at a line frequency of 50 Hz or 60 Hz to the motor drive 104.

The motor drive 104 can be a variable speed drive (VSD) or variable frequency drive (VFD) that receives AC power having a particular fixed line voltage and fixed line frequency from the AC power source 102 and provides power to the motor 106 at a preselected voltage and preselected frequency (including providing a preselected voltage greater than the fixed line voltage and/or providing a preselected frequency greater than the fixed line frequency), both of which can be varied to satisfy particular requirements. Alternatively, the motor drive 104 can be a "stepped" frequency drive that can provide a predetermined number of discrete output frequencies and voltages, i.e., two or more, to the motor 106.

Figure 2:
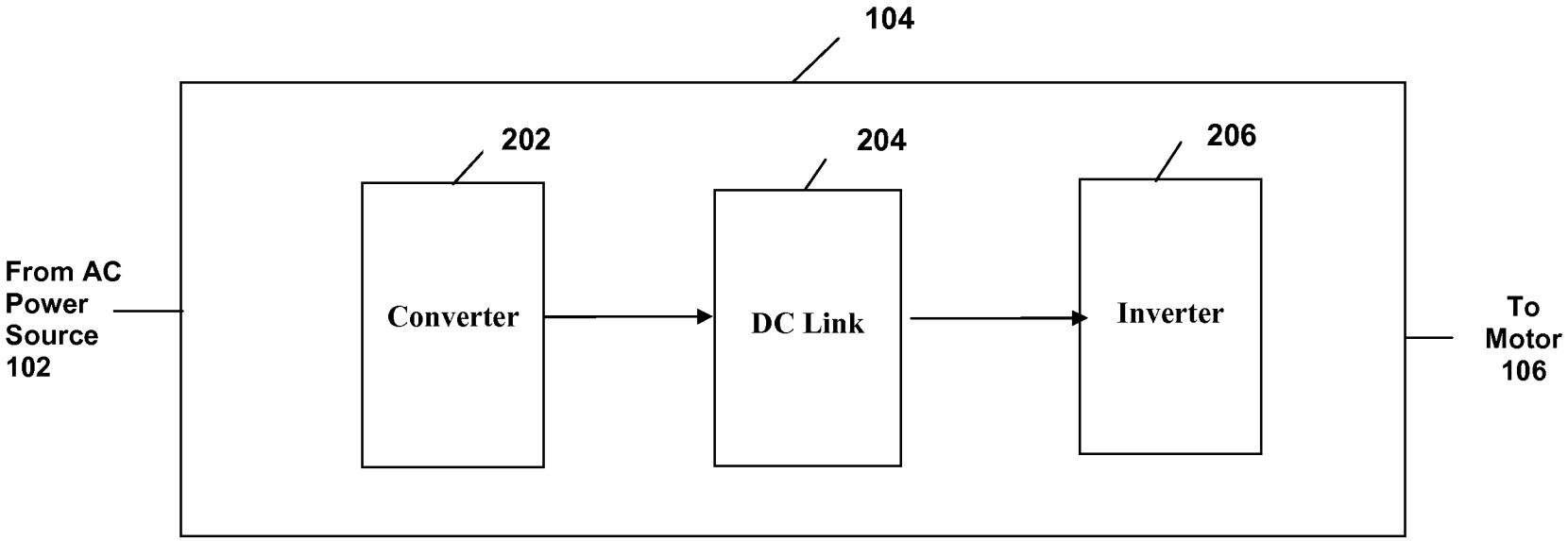
FIG. 2 schematically shows an exemplary embodiment of a motor drive.

FIG. 2 shows one embodiment of a motor drive 104. The motor drive 104 can have three components or stages: a converter or rectifier 202, a DC link or regulator 204 and an inverter 206. The converter 202 converts the fixed line frequency, fixed line voltage AC power from the AC power source 102 into DC power. The DC link 204 filters the DC power from the converter 202 and provides energy storage components. The DC link 204 can include one or more capacitors and/or inductors, which are passive devices that exhibit high reliability rates and very low failure rates. The inverter 206 converts the DC power from the DC link 204 into variable frequency, variable voltage power for the motor 106.

Furthermore, in other exemplary embodiments, the converter 202, DC link 204 and inverter 206 of the motor drive 104 can incorporate several different components and/or configurations so long as the converter 202, DC link 204 and inverter 206 of the motor drive 104 can provide the motor 106 with appropriate output voltages and frequencies.

In an exemplary embodiment, the motor 106 can operate from a voltage that is less than the fixed voltage provided by the AC power source 102 and output by the motor drive 104. By operating at a voltage that is less than the fixed AC voltage, the motor 106 is able to continue operation during times when the fixed input voltage to the motor drive 104 fluctuates.

Figure 3:
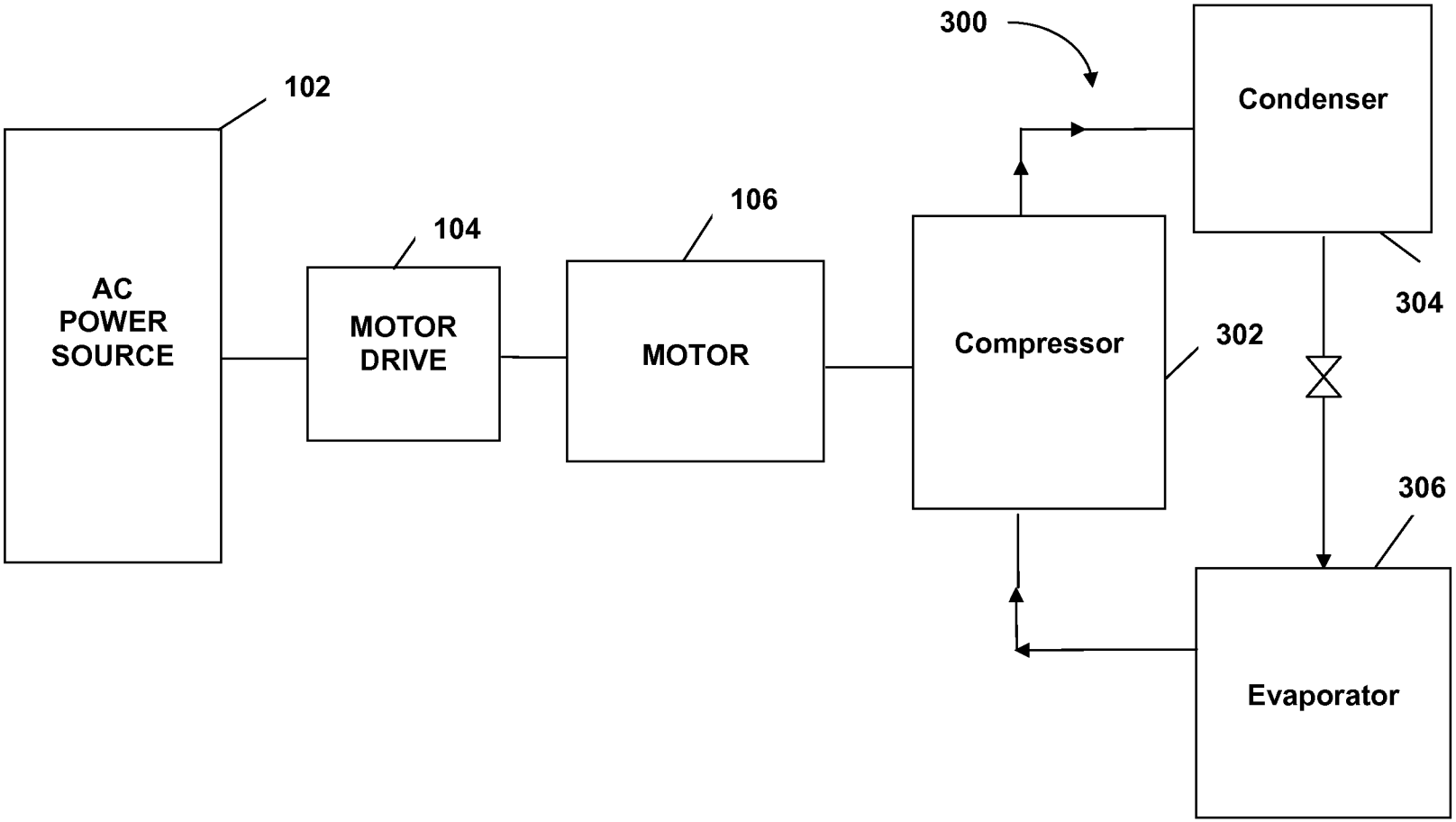
FIG. 3 schematically shows an exemplary embodiment of a vapor compression system.
Figure 4:
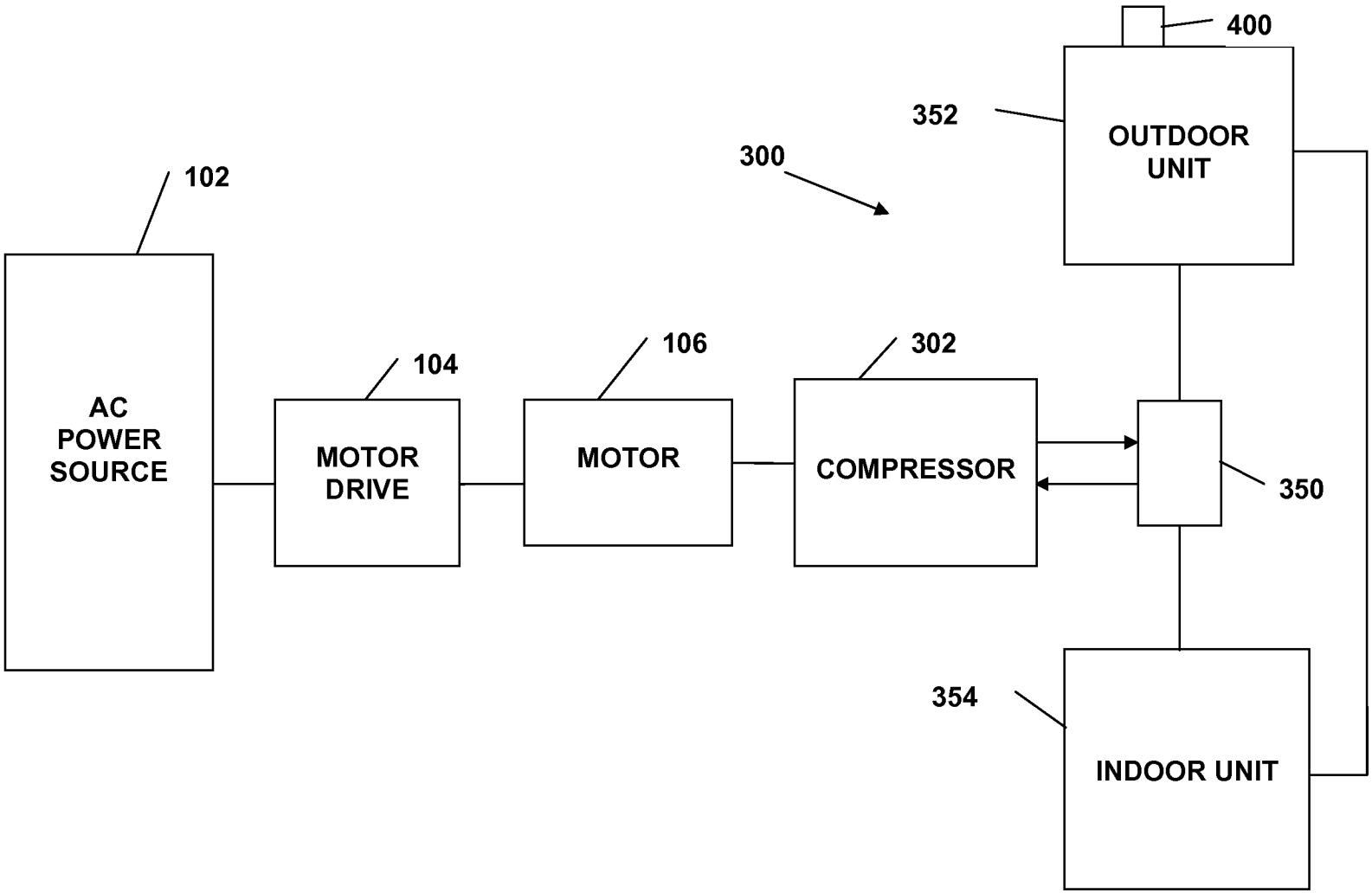
FIG. 4 schematically shows another exemplary embodiment of a vapor compression system.

As shown in FIGS. 3 and 4, a vapor compression system 300 includes a compressor 302, a condenser 304, and an evaporator 306 (see FIG. 3) or a compressor 302, a reversing valve 350, an indoor unit 354 and an outdoor unit 352 (see FIG. 4). The vapor compression system can be included in a heating, ventilation and air conditioning (HVAC) system, refrigeration system, chilled liquid system or other suitable type of system. Some examples of refrigerants that may be used in vapor compression system 300 are hydrofluorocarbon (HFC) based refrigerants, e.g., R-410A, R-407C, R-404A, R-134a or any other suitable type of refrigerant. In addition, a temperature sensor 400 can be used to measure the outdoor ambient temperature.

The vapor compression system 300 can be operated as an air conditioning system, where the evaporator 306 is located inside a structure or indoors, i.e., the evaporator is part of indoor unit 354, to provide cooling to the air in the structure and the condenser 304 is located outside a structure or outdoors, i.e., the condenser is part of outdoor unit 352, to discharge heat to the outdoor air. The vapor compression system 300 can also be operated as a heat pump system, i.e., a system that can provide both heating and cooling to the air in the structure, with the inclusion of the reversing valve 350 to control and direct the flow of refrigerant from the compressor 302. When the heat pump system is operated in an air conditioning mode, the reversing valve 350 is controlled to provide for refrigerant flow as described above for an air conditioning system. However, when the heat pump system is operated in a heating mode, the reversing valve 350 is controlled to provide for the flow of refrigerant in the opposite direction from the air conditioning mode. When operating in the heating mode, the condenser 304 is located inside a structure or indoors, i.e., the condenser is part of indoor unit 354, to provide heating to the air in the structure and the evaporator 306 is located outside a structure or outdoors, i.e., the evaporator is part of outdoor unit 352, to absorb heat from the outdoor air.

Referring back to the operation of the system 300, whether operated as a heat pump or as an air conditioner, the compressor 302 is driven by the motor 106 that is powered by motor drive 104. The motor drive 104 receives AC power having a particular fixed line voltage and fixed line frequency from AC power source 102 and provides power to the motor 106. The motor 106 used in the system 300 can be any suitable type of motor that can be powered by a motor drive 104. The motor 106 can be any suitable type of motor including, but not limited to, an induction motor, a switched reluctance (SR) motor, or an electronically commutated permanent magnet motor (ECM).

Referring back to FIGS. 3 and 4, the compressor 302 compresses a refrigerant vapor and delivers the vapor to the condenser 304 through a discharge line (and the reversing valve 350 if configured as a heat pump). The compressor 302 can be any suitable type of compressor including, but not limited to, a reciprocating compressor, rotary compressor, screw compressor, centrifugal compressor, scroll compressor, linear compressor or turbine compressor. The refrigerant vapor delivered by the compressor 302 to the condenser 304 enters into a heat exchange relationship with a fluid, e.g., air or water, and undergoes a phase change to a refrigerant liquid as a result of the heat exchange relationship with the fluid. The condensed liquid refrigerant from the condenser 304 flows through an expansion device to the evaporator 306.

The condensed liquid refrigerant delivered to the evaporator 306 enters into a heat exchange relationship with a fluid, e.g., air or water, and undergoes a phase change to a refrigerant vapor as a result of the heat exchange relationship with the fluid. The vapor refrigerant in the evaporator 306 exits the evaporator 306 and returns to the compressor 302 by a suction line to complete the cycle (and the reversing valve arrangement 350 if configured as a heat pump). In other exemplary embodiments, any suitable configuration of the condenser 304 and the evaporator 306 can be used in the system 300, provided that the appropriate phase change of the refrigerant in the condenser 304 and evaporator 306 is obtained. For example, if air is used as the fluid to exchange heat with the refrigerant in the condenser or the evaporator, then one or more fans can be used to provide the necessary airflow through the condenser or evaporator. The motors for the one or more fans may be powered directly from the AC power source 102 or a motor drive, including motor drive 104.

Figure 5:
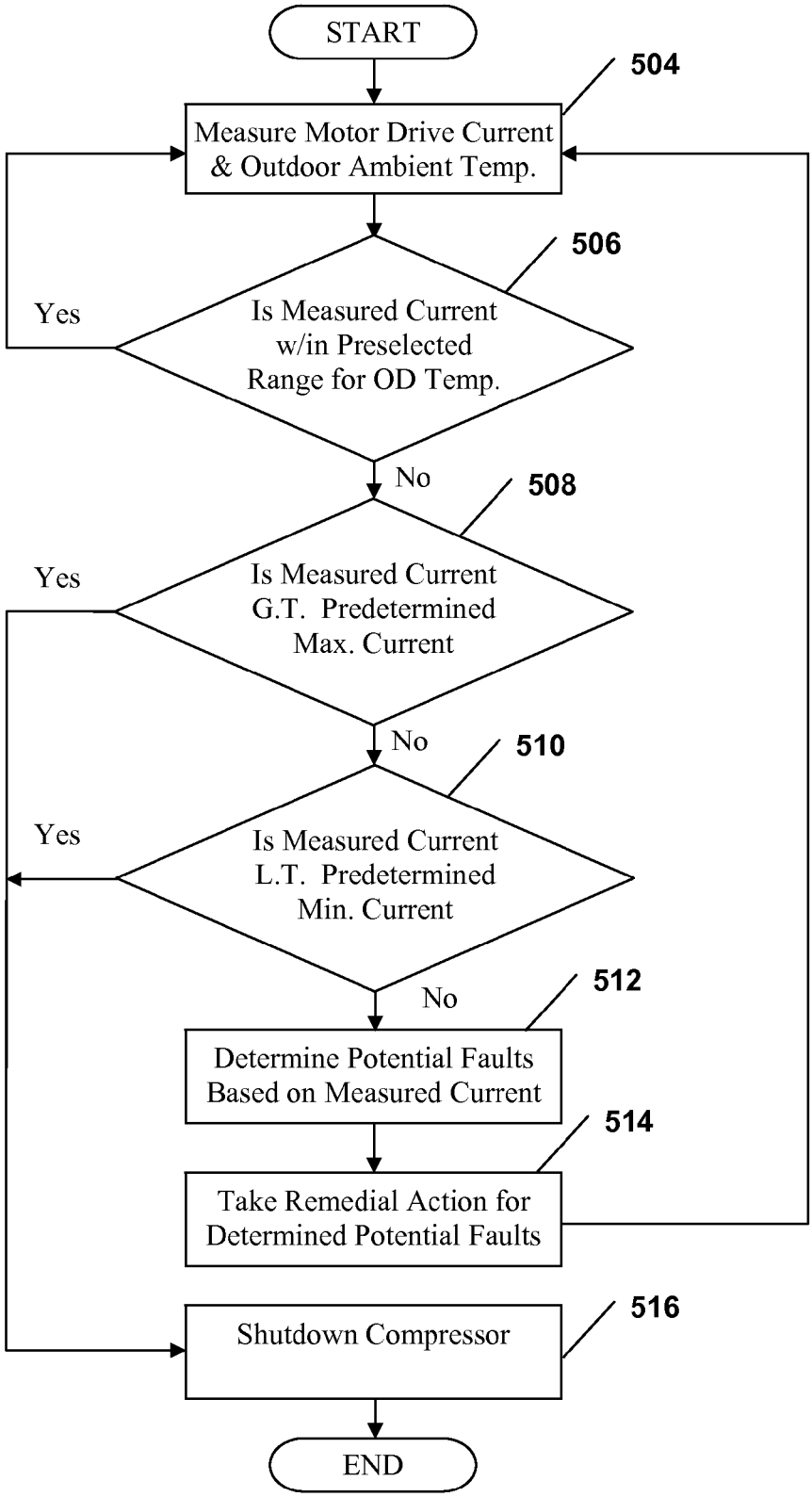
FIG. 5 shows an exemplary embodiment of a process for determining fault conditions in a compressor.

FIG. 5 shows an embodiment of a process for determining fault conditions in a compressor in an HVAC system. The process can occur while a controller (see e.g., FIG. 6) executes a compressor control program or algorithm to control the speed and/or output capacity of the compressor. The controller can be any suitable device used to control operation of the motor drive and/or the compressor. The controller can be incorporated into the motor drive used with the compressor, incorporated in a thermostat for an HVAC system that includes the compressor or positioned as a separate component from the motor drive and/or the thermostat. The controller can execute any suitable type of compressor control algorithm that can satisfy the requirements of the HVAC system.

The fault detection process begins by measuring the current of the motor drive and the outdoor ambient temperature (step 504). The measured current of the motor drive can be the output current provided to the motor, a DC bus current in the motor drive, an AC ripple current in the motor drive, the current provided to the motor drive by the AC power source or any combination of these currents. The outdoor ambient temperature can be measured using a temperature sensor (see e.g., FIG. 4). In an exemplary embodiment, the outdoor temperature sensor can be located near the outdoor unit as shown in FIG. 4, but the outdoor temperature sensor can be located in a suitable location that can provide a measurement of the outdoor ambient temperature. In another exemplary embodiment, other operating parameters of the motor drive, compressor and/or the HVAC system can be measured instead or in addition to the current of the motor drive and the outdoor ambient temperature. Some of the other operating parameters that can be measured and/or used to determine for fault conditions are the voltage of the motor drive, e.g., the voltage from the AC power source or the DC bus voltage, the operational status (i.e., on or off) or the speed of the fans used with the HVAC system, the speed of the motor, the operational mode, i.e., heating or cooling, of the HVAC system, compressor motor temperature and/or the system pressures and temperatures in the HVAC system.

Figure 7:
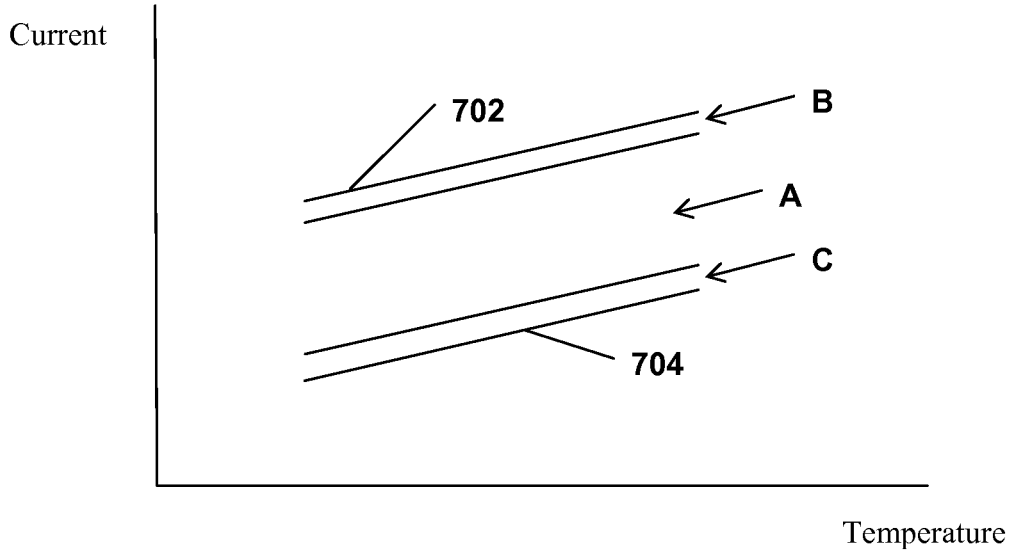
FIG. 7 shows an exemplary current range for a fault detection process.

Next, the measured current and outdoor ambient temperature are evaluated to determine if the measured current is within a preselected range that corresponds to regular or acceptable operation of the compressor, i.e., operation of the compressor is within predetermined parameters (step 506). FIG. 7 shows an exemplary preselected range for the motor drive current. In FIG. 7, a first preselected range (A) for the motor drive current can have an upper limit for a corresponding outdoor ambient temperature and a lower limit for a corresponding outdoor ambient temperature that define the boundaries for regular compressor operation. In addition, the motor drive current can have a second preselected range (B) between the first preselected range (A) and an maximum current limit for the compressor at a corresponding outdoor ambient temperature. Similarly, the motor drive current can have a third preselected range (C) between the first preselected range (A) and a minimum current limit for the compressor at a corresponding outdoor ambient temperature. The maximum current limit for the motor drive current is defined by line 702 and the minimum current limit for the motor drive current is defined by line 704.

In an exemplary embodiment, the preselected ranges for the motor drive current, the maximum current limit and the minimum current limit can be preselected independent of the outdoor ambient temperature. In other words, only the measured motor drive current may be used to determine a fault condition.

In another exemplary embodiment, the speed of the compressor can also be included as a factor in determining if the motor drive current is within the first preselected range (A). As previously discussed, the motor drive current can be evaluated using a preselected range for the motor drive current based on the outdoor ambient temperature, except that the preselected range for the motor drive current can vary depending on the speed of the compressor. In an additional exemplary embodiment, if other operating parameters are measured, similar preselected ranges can be determined based on the outdoor ambient temperature and any other operating parameter. If the measured motor drive current is within the preselected range, e.g., the measured current is region A, then the process returns to measure the motor drive current and outdoor ambient temperature (step 504).

However, if the measured motor drive current is outside the preselected range, then a comparison can be made of the measured motor drive current and a predetermined maximum current value (step 508). If the measured motor drive current is greater than the predetermined maximum current value, the compressor can be shutdown (step 516) because a fault condition is present in the compressor. However, if the measured motor drive current is not greater than the predetermined maximum current value, then a comparison can be made of the measured motor drive current and a predetermined minimum current value (step 510). If the measured motor drive current is less than the predetermined minimum current value, the compressor can be shutdown (step 516) because a fault condition is present in the compressor. In contrast, if the measured motor drive current is not less than the predetermined minimum current value, then the measured motor drive current is located in regions B or C (see FIG. 7) and a determination of any potential faults in the compressor (and possibly in the HVAC system) can be made (step 512).

The determination of a potential fault can be made based on which region, B or C, the measured motor drive current is located. For example, if the measured motor drive current is located in region C, then a low pressure condition may be developing in the compressor. Similarly, if the measured motor drive current is located in region B, then a high pressure condition and/or a high current condition may be developing in the compressor. In an exemplary embodiment, other factors or measured operating parameters, including the outdoor ambient temperature, can be used with the measured motor drive current to determine a potential fault in the compressor. In another exemplary embodiment, more than one potential fault condition may be identified based on the measured motor drive current. In still another exemplary embodiment, the measured motor drive current and outdoor ambient temperature can be used to determine a low refrigerant charge condition in the compressor.

Once the potential fault condition(s) is identified, then the controller can take remedial actions to attempt to remedy the potential fault condition (step 514). Some examples of remedial actions that may be taken by the controller based on the determined fault condition include, increasing or decreasing the speed of the compressor, increasing or decreasing the voltage provided to the motor, opening or closing a valve, adjusting the speed of the condenser or evaporator fans (possibly in conjunction with thermostat controls). In one exemplary embodiment, if a potential high pressure condition is determined, the controller can reduce the output frequency of the motor drive (and the corresponding speed of the compressor) by a predetermined amount, e.g., about 1 Hz to about 20 Hz. If there are multiple determined potential fault conditions, the controller may take several different actions either individually (each action based on a determined potential fault) or in combination (the combination of determined potential faults determines the actions, which may not correspond to the individual actions for the potential faults). After the controller implements the remedial action(s), possibly by overriding the compressor control program, the process returns to measure the outdoor ambient temperature and the motor drive current (step 504) and repeat the process. If the remedial action(s) by the controller have brought the measured motor drive current within the preselected range, the controller can operate under the remedial conditions for a predetermined time period before returning to operation under the compressor control program. By identifying and responding to potential fault conditions, the controller can prevent fault conditions from occurring that would shutdown the compressor.

In an exemplary embodiment, the remedial action may be to permit operation in regions B or C for a predetermined time period to avoid having unnecessary shutdowns or speed changes. If the measured current does not return to region A during the predetermined time period, a shutdown of the compressor can occur.

Figure 6:
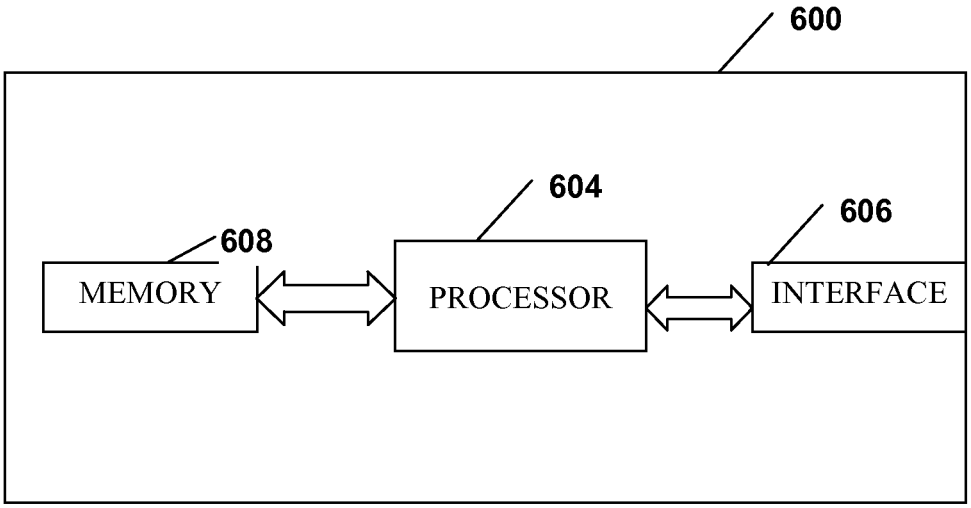
FIG. 6 schematically shows an exemplary embodiment of a controller.

FIG. 6 shows an embodiment of a controller that can be used to control the compressor and/or motor drive. The controller 600 can include a processor 604 that can communicate with an interface 606. The processor 604 can be any suitable type of microprocessor, processing unit, or integrated circuit. The interface 606 can be used to transmit and/or receive information, signals, data, control commands, etc. A memory device(s) 608 can communicate with the processor 604 and can be used to store the different preselected ranges, other control algorithms, system data, computer programs, software or other suitable types of electronic information.

Embodiments within the scope of the present application include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

While only certain features and embodiments of the invention have been shown and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Also, two or more steps may be performed concurrently or with partial concurrence. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A method of determining fault conditions in a compressor for a heating, ventilation, and air conditioning (HVAC) system comprising:

storing a plurality of predefined ranges of current values for a motor drive current, each predefined range of current values of the plurality of predefined ranges of current values being associated with a corresponding outdoor ambient temperature and including:

a maximum current value;

an upper current value less than the maximum current value;

a minimum current value;

a lower current value greater than the minimum current value;

a first range of current values being bounded by the upper current value and the lower current value;

a second range of current values being bounded by the maximum current value and the upper current value; and a third range of current values being bounded by the lower current value and the minimum current value;

measuring an outdoor ambient temperature for the HVAC system;

measuring a current of a motor drive for the compressor;

selecting a predefined range of current values from the plurality of predefined ranges of current values using the measured outdoor ambient temperature;

comparing the measured current to the first range of current values, the second range of current values and the third range of current values;

determining acceptable operation of the compressor in response to the measured current being located in the first range of current values;

determining a potential fault condition in response to the measured current being located in either the second range of current values or the third range of current values, the determined potential fault condition being based on the range of current values in which the measured current is located; and changing an operating condition of the compressor in response to the determined potential fault condition.

2. The method of claim 1 further comprising shutting down the compressor in response to the measured current being greater than the maximum current value for the selected predefined range of current values.

3. The method of claim 1 further comprising shutting down the compressor in response to the measured current being less than the minimum current value for the selected predefined range of current values.

4. The method of claim 1 wherein the changing an operating condition of the compressor comprises at least one of increasing compressor speed, decreasing compressor speed, adjusting a voltage provided to a motor of the compressor, opening a valve, closing a valve or adjusting a fan speed of a component of the HVAC system.

5. The method of claim 1 wherein the determining a potential fault condition comprises determining a high pressure condition in response to the measured current being located in the second range of current values.

6. The method of claim 1 wherein the determining a potential fault condition comprises determining a high current condition in response to the measured current being located in the second range of current values.

7. The method of claim 1 wherein the determining a potential fault condition comprises determining a low pressure condition in response to the measured current being located in the third range of current values.

8. The method of claim 1 wherein the determining a potential fault condition further comprises determining a potential fault condition in response to the measured current being greater than the upper current value or less than the lower current value and an evaluation of at least one additional measured operating parameter.

9. The method of claim 8 wherein the at least one additional operating parameter comprises at least one of a voltage of the motor drive, a speed of a motor for the compressor or a temperature of the motor for the compressor.

10. A system comprising:

a compressor;

a motor drive operable to receive power from an AC power source and to provide power to the compressor at a plurality of voltages and a plurality of frequencies, the motor drive comprising a first sensor to measure a value representative of a current in the motor drive;

a second sensor positioned to measure a value representative of the outdoor ambient temperature; and a controller to control operation of the motor drive, the controller comprising:

an interface to receive the value representative of a current in the motor drive and the value representative of the outdoor ambient temperature;

a memory device storing a plurality of predefined ranges of current values for the motor drive current, each predefined range of current values of the plurality of predefined ranges of current values being associated with a corresponding outdoor ambient temperature and including:

a maximum current value;

an upper current value less than the maximum current value;

a minimum current value;

a lower current value greater than the minimum current value;

a first range of current values being bounded by the upper current value and the lower current value;

a second range of current values being bounded by the maximum current value and the upper current value; and a third range of current values being bounded by the lower current value and the minimum current value; and a processor operable to determine a fault condition in the compressor by comparing the value representative of a current in the motor drive to the second and third ranges of current values for the motor drive, the determined fault condition being based on the range of current values in which the measured current is located and to initiate a remedial action to continue operation of the compressor upon a fault condition being determined, the initiated remedial action being selected based on the determined fault condition.

11. The system of claim 10 wherein the processor is operable to determine a high current fault condition in response to the value representative of a current in the motor drive being within the second range of current values.

12. The system of claim 10 wherein the processor is operable to determine a low pressure fault condition in response to the value representative of a current in the motor drive being within the third range of current values.

13. The system of claim 10 wherein the processor is operable to determine a high pressure fault condition in response to the value representative of a current in the motor drive being within the second range of current values.

14. The system of claim 10 wherein the processor is operable to shut down the compressor in response to the value representative of a current in the motor drive being greater than the maximum current value.

15. The system of claim 10 wherein the processor is operable to shut down the compressor in response to the value representative of a current in the motor drive being less than the minimum current value.

16. The system of claim 10 wherein the processor is configured to initiate at least one of increasing compressor speed, decreasing compressor speed, adjusting a voltage provided to a motor of the compressor, opening a valve, closing a valve or adjusting a fan speed of a component of the HVAC system in response to a fault condition being determined.

17. The system of claim 10 wherein the processor is configured to initiate a remedial action by permitting continued operation of the compressor and the motor drive without change for a predetermined time period.

18. The method of claim 1 wherein the selecting a predefined range of current values from the plurality of predefined ranges of current values includes selecting a predefined range of current values from a plurality of predefined ranges of current values based on the measured outdoor ambient temperature and a speed of a motor of the compressor.

* * * * *